US009689077B2

(12) United States Patent
Rosvall et al.

(10) Patent No.: US 9,689,077 B2
(45) Date of Patent: Jun. 27, 2017

(54) ACTIVATION OF CATHODE

(75) Inventors: Magnus Rosvall, Göteborg (SE); Kristoffer Hedenstedt, Göteborg (SE); Annicka Sellin, Göteborg (SE); Johan Gustavsson, Stockholm (SE); Ann Cornell, Lidingö (SE)

(73) Assignee: Akzo Nobel Chemicals International B.V., Amersfoort (NL)

( * ) Notice: Subject to any disclaimer, the term of this patent is extended or adjusted under 35 U.S.C. 154(b) by 193 days.

(21) Appl. No.: 13/320,695

(22) PCT Filed: Apr. 23, 2010

(86) PCT No.: PCT/EP2010/055409

§ 371 (c)(1),
(2), (4) Date: Nov. 15, 2011

(87) PCT Pub. No.: WO2010/130546

PCT Pub. Date: Nov. 18, 2010

(65) Prior Publication Data

US 2012/0061252 A1 Mar. 15, 2012

Related U.S. Application Data

(60) Provisional application No. 61/178,621, filed on May 15, 2009.

(30) Foreign Application Priority Data

May 15, 2009 (EP) ..... 09160401

(51) Int. Cl.
*C25B 1/26* (2006.01)

(52) U.S. Cl.
CPC ..... *C25B 1/265* (2013.01)

(58) Field of Classification Search
CPC ..... C25B 1/265
USPC ..... 205/502–505
See application file for complete search history.

(56) References Cited

U.S. PATENT DOCUMENTS 3,180,811 A * 4/1965 Schwanbom et al. ..... 205/338
3,535,216 A * 10/1970 Cook, Jr. et al. ..... 205/504
3,616,443 A * 10/1971 Cook et al. ..... 204/278
3,676,315 A * 7/1972 Goens et al. ..... 205/505
3,791,947 A * 2/1974 Loftfield ..... 205/500
3,948,748 A * 4/1976 Messner et al. ..... 204/270
3,948,749 A * 4/1976 Sargent ..... 204/279
4,300,992 A * 11/1981 Yoshida et al. ..... 204/242
4,422,917 A 12/1983 Hayfield
5,419,818 A 5/1995 Wanngard
6,352,625 B1 3/2002 Andolfatto et al.
2005/0011753 A1* 1/2005 Jackson ..... C25B 1/265 204/252
2007/0012579 A1* 1/2007 Rosvall ..... C01B 7/03 205/474

FOREIGN PATENT DOCUMENTS

EP 0 498 484 A1 8/1992
EP 1 242 654 B1 9/2002
FR 362 737 A 7/1906
GB 905 749 A 9/1962
JP 2002506120 A 2/2002

OTHER PUBLICATIONS

European Search Report for Application No. EP 09 16 0401 dated Jul. 22, 2009.
International Search Report with Written Opinion for International Application No. PCT/EP2010/055409 dated Jul. 2, 2010.
International Preliminary Report on Patentability for International Application No. PCT/EP2010/055409 dated Sep. 5, 2011.
Japanese Office Action for corresponding Japanese Application No. 2012-510193 dated Oct. 1, 2013.

* cited by examiner

*Primary Examiner* — Ciel Thomas
(74) *Attorney, Agent, or Firm* — Norris McLaughlin & Marcus, P.A.

(57) ABSTRACT

The present invention relates to a process for production of alkali metal chlorate, and to a method of activating a cathode comprising electrolyzing an electrolyte comprising alkali metal chloride in an electrolytic cell in which at least one anode and at least one cathode are arranged wherein a) said electrolyte comprises chromium in any form in an amount ranging from about $0.01\text{-}10^{-6}$ to about $500\text{-}10^{-6}$ mol/dm$^3$ b) said electrolyte comprises molybdenum, tungsten, vanadium, manganese and/or mixtures thereof in any form in a total amount ranging from about $0.1\text{-}10^{-6}$ mol/dm$^3$ to about $0.5\text{-}10^{-3}$ mol/dm$^3$.

16 Claims, No Drawings

ACTIVATION OF CATHODE

This application is a national stage filing under 35 U.S.C. §371 of PCT/PCT/EP2010/055409, filed Apr. 23, 2010, which claims priority to European Patent Application No. 09160401.7, filed May 15, 2009, and U.S. Provisional Patent Application No. 61/178,621, filed on May 15, 2009, the contents of which are incorporated herein by reference in their entirety.

The present invention relates to a process of producing alkali metal chlorate and to a process for activation of a cathode.

BACKGROUND OF THE INVENTION

The electrolytic production of alkali metal chlorate, and especially sodium chlorate, is well known. Alkali metal chlorate is an important chemical, particularly in the pulp and paper industry as a raw material for the production of chlorine dioxide that is widely used for bleaching. Conventionally, it is produced by electrolysis of alkali metal chlorides in non-divided electrolytic cells. The overall chemical reaction taking place in such cells is

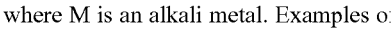

$$MCl+3H_2O \rightarrow MClO_3+3H_2$$

where M is an alkali metal. Examples of chlorate processes are described in inter alia U.S. Pat. No. 5,419,818 and EP 1 242 654.

During the production of sodium chlorate, sodium chloride is oxidized to form chlorine on the anode which subsequently transforms to sodium chlorate under controlled chemical conditions. On the cathode, water is reduced to form hydrogen gas as a by-product of the electrochemical reaction.

U.S. Pat. No. 3,535,216 discloses a process of producing chlorate in a chlorate cell equipped with steel cathodes.

However, steel cathodes are not stable over time in the chlorate process. Steel may also corrode in the electrolyzer. Steel cathodes may also conduct atomic hydrogen whereby connection between steel cathodes and titanium based anodes in bipolar cells may need a back-plate to prevent formation of titanium hydride. Also, it has been found that the use of sodium dichromate and molybdic acid in amounts described in U.S. Pat. No. 3,535,216 results in considerable evolution of oxygen, which is undesirable, as well as high cell voltage.

The object of the present invention is to provide a process of producing alkali metal chlorate which reduces the cell voltage. A further object is to provide a process of activating the cathode in such cell in a convenient and efficient way while using low amounts of chromium and activating metal(s). A further object of the invention is to provide a process with high cathodic current efficiency. A further object is to provide a process in which the formation of oxygen is decreased whereby energy losses and the risk of explosions in the cell also are decreased.

THE INVENTION

The present invention relates to a process for production of alkali metal chlorate comprising electrolyzing an electrolyte comprising alkali metal chloride in an electrolytic cell in which at least one anode and at least one cathode are arranged wherein a) said electrolyte comprises chromium in any form in an amount ranging from about $0.01\cdot10^{-6}$ to about $500\cdot10^{-6}$ mol/dm$^3$ b) said electrolyte comprises molybdenum, tungsten, vanadium, manganese and/or mixtures thereof in any form in a total amount ranging from about $0.1\cdot10^{-6}$ to about $0.5\cdot10^{-3}$ mol/dm$^3$.

The present invention also relates to a process for activation of a cathode in an electrolytic cell for production of alkali metal chlorate comprising electrolyzing an electrolyte comprising alkali metal chloride in an electrolytic cell in which at least one anode and at least one cathode are arranged, wherein a) said electrolyte comprises chromium in any form in an amount ranging from about $0.01\cdot10^{-6}$ to about $500\cdot10^{-6}$ mol/dm$^3$ b) said electrolyte comprises molybdenum, tungsten, vanadium, manganese and/or mixtures thereof in any form in a total amount ranging from about $0.1\cdot10^{-6}$ to about $0.5\cdot10^{-3}$ mol/dm$^3$.

The metals molybdenum, tungsten, vanadium, manganese and/or mixtures thereof are referred to herein as "activating metals", which may be used in any form, for example elemental, ionic, and/or in a compound. According to one embodiment, should mixtures of activating metals be used, the total amount should be within the claimed ranges.

According to one embodiment, the electrolyte solution comprises chromium in any form, typically in ionic form such as dichromates and other forms of hexavalent chromium but also in forms such as trivalent chromium, suitably added as a hexavalent chromium compound such as $Na_2CrO_4$, $Na_2CrO_7$, $CrO_3$, or mixtures thereof.

According to one embodiment, the electrolyte solution comprises chromium in any form in an amount from about $0.01\cdot10^{-6}$ to about $100\cdot10^{-6}$, for example from about $0.1\cdot10^{-6}$ to about $50\cdot10^{-6}$, or from about $5\cdot10^{-6}$ to about $30\cdot10^{-6}$ mol/dm$^3$.

According to one embodiment, the electrolyte comprises molybdenum, tungsten, vanadium, manganese and/or mixtures thereof in any form, for example of molybdenum, in a total amount ranging from about $0.001\cdot10^{-3}$ to about $0.1\cdot10^{-3}$, or from about $0.01\cdot10^{-3}$ to about $0.05\cdot10^{-3}$ mol/dm$^3$.

According to one embodiment, the electrolyte may further comprise a buffering agent, such as bicarbonate (e.g. $NaHCO_3$).

According to one embodiment, the electrolyte is substantially free from iron in any form, elemental, ionic, or iron compounds. By "substantially free" is here meant the amount of iron in the electrolyte is less than $0.5\cdot10^{-3}$ mol/dm$^3$ or less than $0.01\cdot10^{-3}$ mol/dm$^3$ According to one embodiment, the anode and/or cathode comprise a substrate, for example comprising at least one of titanium, molybdenum, tungsten, titanium suboxide, titanium nitride ($TiN_x$), MAX phase, silicon carbide, titanium carbide, graphite, glassy carbon or mixtures thereof. According to one embodiment, the cathode is essentially free from iron or iron compounds. According to one embodiment, the cathode may comprise up to 5 wt %, for example up to 1 wt %, or up to 0.1 wt % iron based on the total weight of the cathode. However, the cathode is preferably void of iron or iron compounds.

According to one embodiment, the cathode may comprise a core of iron provided the cathode surface is covered with a corrosion-resistant material such that the cathode or cathode substrate surface is essentially free from iron or iron compounds.

According to one embodiment, the substrate is made up of a Max phase which comprises $M_{(n+1)}AX_n$, where M is a metal of group IIIB, IVB, VB, VIB or VIII of the periodic table of elements or a combination thereof, A is an element of group IIIA, IVA, VA or VIA of the periodic table of elements or a combination thereof, X is carbon, nitrogen or a combination thereof, where n is 1, 2, or 3.

According to one embodiment, M is scandium, titanium, vanadium, chromium, zirconium, niobium, molybdenum, hafnium, tantalum or combinations thereof, for example titanium or tantalum. According to one embodiment, A is aluminum, gallium, indium, thallium, silicon, germanium, tin, lead, sulphur, or combinations thereof, for example silicon.

According to one embodiment, the electrode substrate is selected from any of $Ti_2AlC$, $Nb_2AlC$, $Ti_2GeC$, $Zr_2SnC$, $Hf_2SnC$, $Ti_2SnC$, $Nb_2SnC$, $Zr_2PbC$, $Ti_2AlN$, $(Nb,Ti)_2AlC$, $Cr_2AlC$, $Ta_2AlC$, $V_2AlC$, $V_2PC$, $Nb_2PC$, $Nb_2PC$, $Ti_2PbC$, $Hf_2PbC$, $Ti_2AlN_{0.5}C_{0.5}$, $Zr_2SC$, $Ti_2SC$, $Nb_2SC$, $Hf_2Sc$, $Ti_2GaC$, $V_2GaC$ $Cr_2GaC$, $Nb_2GaC$, $Mo_2GaC$, $Ta_2GaC$, $Ti_2GaN$, $Cr_2GaN$, $V_2GaN$, $V_2GeC$, $V_2AsC$, $Nb_2AsC$, $Ti_2CdC$, $Sc_2InC$, $Ti_2InC$, $Zr_2InC$, $Nb_2InC$, $Hf_2InC$, $Ti_2InN$, $Zr_2InN$, $Hf_2InN$, $Hf_2SnN$, $Ti_2TlC$, $Zr_2TlC$, $Hf_2TlC$, $Zr_2TlN$, $Ti_3AlC_2$, $Ti_3GeC_2$, $Ti_3SiC_2$, $Ti_4AlN_3$ or combinations thereof. According to one embodiment, the electrode substrate is any one of $Ti_3SiC_2$, $Ti_2AlC$, $Ti_2AlN$, $Cr_2AlC$, $Ti_3AlC_2$, or combinations thereof. Methods of preparing materials as listed and which may be used as electrode substrate in the present invention are known from The MaxPhases:Unique New Carbide and Nitride Materials, American Scientist, Volume 89, p. 334-343, 2001.

According to one embodiment, the anode and/or cathode substrate consists of titanium-based material selected from $TiO_x$ (titanium suboxide) wherein x is a number in the range from about 1.55 to about 1.99, such as from about 1.55 to about 1.95, such as from about 1.55 to about 1.9, such as from about 1.6 to about 1.85 or from about 1.7 to about 1.8. The titanium oxide may predominantly be $Ti_4O_7$ and/or $Ti_5O_9$.

According to one embodiment, the anode and/or cathode substrate comprises; titanium, titanium nitride ($TiN_x$) wherein x ranges from about 0.1 to about 1, titanium carbide (TiC) or mixtures thereof.

According to one embodiment, the material may be monolithic, wherein x can be greater than 1.67 to provide for good strength. Methods of preparing these materials are known from "Development of a New Material—Monolithic $Ti_4O_7$ Ebonex® Ceramic", by P. C. S. Hayfield, ISBN 0-85404-984-3, and is also described in U.S. Pat. No. 4,422,917.

According to one embodiment, the cathode material may also be composed of a gradual transition from barrier material to electrocatalytic material. For example, the interior material may be for example $TiO_x$ whereas the superficial material is based on for example $TiO_2/RuO_2$.

According to one embodiment, the anode may also be made up of tantalum, niobium and zirconium. Typically, the anode includes one or more anode coating(s) on the surface of the anode substrate. Further useful anode coatings may include those comprising ruthenium, titanium, tantalum, niobium, zirconium, platinum, palladium, iridium, tin, rhodium, antimony, and appropriate alloys, combinations, and/or oxides thereof. In some embodiments, the anode coating is a ruthenium-antimony oxide anode coating or derivative thereof. In other embodiments, the anode coating is a ruthenium-titanium oxide anode coating or derivative thereof. In other embodiments, the anode coating is a ruthenium-titanium-antimony anode oxide coating or derivative thereof. In some embodiments, the anode is a dimensionally stable anode (DSA).

According to one embodiment, the density of the anode and/or cathode can range, independently of each other, from about 3 to about 20, for example from about 4 to about 9, or from about 4 to about 5 g/cm$^3$.

According to one embodiment, the thickness of the anode and cathode range, independently of each other, from about 0.05 to about 15, from about 0.05 to about 10, such as from about 0.5 to about 10, from about 0.5 to about 5, from about 0.5 to about 2.5, or from about 1 to about 2 mm.

According to one embodiment, the cathode may comprise a substrate comprising titanium having a protective layer between the substrate and an electrocatalytic coating as disclosed herein. The protective layer may comprise $TiO_x$ wherein x is a number in the region from about 1.55 to about 1.95. The titanium oxide may predominantly be $Ti_4O_7$ and/or $Ti_5O_9$. According to one embodiment, the protective layer may be monolithic, wherein x can be greater than 1.67 for strength reasons. The protective layer may comprise $TiN_x$ wherein x ranges from about 0.1 to about 1.

According to one embodiment, the anode and/or cathode comprise a substrate which can be roughened by means of machining, sand blasting, grit blasting, chemical etching and the like or combinations like blasting with etchable particles followed by etching. The use of chemical etchants is well known and such etchants include most strong inorganic acids, such as hydrochloric acid, hydrofluoric acid, sulphuric acid, nitric acid and phosphoric acid, but also organic acids such as oxalic acid. According to one embodiment, a roughened, blasted and pickled electrode substrate is coated with an electrocatalytic coating, for example by means of dipping, painting, rolling or spraying.

A "cathode electrodepositing solution" is part of the electrolyte solution containing activating metal(s) which are deposited onto a cathode to form a cathode coating. Where the anode includes a coating, the electrolyte should not contain material which degrades the anode coating. According to one embodiment, the cathode coating may cover a portion or the whole cathode substrate in order to decrease the overvoltage.

According to one embodiment, the electrolyte may contain activating metals suitable for deposition on the cathode such as molybdenum, tungsten, vanadium, manganese, and mixtures thereof in any form added to the electrolyte in a suitable form, for example elemental form and/or as compounds.

According to one embodiment, the configuration of the electrode, i.e. anode and/or cathode, may, for example, take the shape of a flat sheet or plate, a curved surface, a convoluted surface, a punched plate, a woven wire screen, an expanded mesh sheet, a rod, a tube or a cylinder. According to one embodiment, cylindrical shape is preferred.

The term "in-situ activation" means activation of the cathode (e.g. coating, electrodepositing) performed for example while the process of producing alkali metal chlorate is running in the electrolytic chlorate cell. The in-situ activation does not require mechanical disassembly of the electrolytic cell to separate one or more anode plates from cathode plates, for example between electrodeposition and chlorate production.

According to one embodiment, "in-situ activation" as used herein also covers e.g. activation while operating the plant temporarily in an "activation mode", i.e. under conditions specifically designed for optimal activation. This could include running with the crystallization disabled in order to not contaminate the product with activating metal(s) and/or improve the utilization of the activating metal(s).

This could involve for example temporary running at a higher current density to speed up deposition of activating metal. This could also involve running the cell while producing alkali metal chlorate crystals but at slightly different process conditions, for example modified pH. According to one embodiment, "in-situ activation" also comprises intermittent and irregular charging, for example as a step in the start-up procedure. According to one embodiment, in-situ activation also comprises activation of a cell or a number of cells in off line mode using a special composition of electrolyte.

According to one embodiment, the electrolytic cell is an undivided cell. An "undivided electrolytic chlorate cell" is an electrolytic chlorate cell that has no physical barrier (e.g. a membrane or diaphragm) between the anode and the cathode that functions to separate the electrolyte. Thus, the cathode and anode are present in a single compartment. According to one embodiment, the electrolytic cell may be a divided cell.

According to one embodiment, the process of producing alkali metal chlorate comprises introducing an electrolyte solution containing alkali metal halide and alkali metal chlorate to an electrolytic cell as defined herein, electrolyzing the electrolyte solution to produce an electrolyzed chlorate solution, transferring the electrolyzed chlorate solution to a chlorate reactor to react the electrolyzed chlorate solution further to produce a more concentrated alkali metal chlorate electrolyte. As the electrolysis occurs, chlorine formed at the anode immediately hydrolyses and forms hypochlorite while hydrogen gas is formed at the cathode.

According to one embodiment, the current density at the anode may range from about 0.6 to about 4, from about 0.8 to about 4, from about 1 to about 4, for example from about 1 to about 3.5, or from about 2 to about 2.5 $kA/m^2$.

According to one embodiment, the current density at the cathode ranges from about 0.05 to about 4, for example from about 0.1 to about 3, for example from about 0.6 to about 3 or from about 1 to about 2.5 $kA/m^2$.

According to one embodiment, the chlorate formed is separated by crystallization while the mother liquor is recycled and enriched with chloride for further electrolysis to form hypochlorite.

According to one embodiment, the chlorate containing electrolyte is transferred to a separate reactor where it is converted to chlorine dioxide, which is separated as a gaseous stream. The chlorate depleted electrolyte is then transferred back to the chlorate unit and enriched with chloride for further electrolysis to form hypochlorite.

According to one embodiment, pH is adjusted in several positions within the range 5.5-12 to optimize the process conditions for the respective unit operation. Thus, a weakly acid or neutral pH is used in the electrolyzer and in the reaction vessels to promote the reaction from hypochlorite to chlorate, while the pH in the crystallizer is alkaline to prevent gaseous hypochlorite and chlorine from being formed and released and to reduce the risk of corrosion. According to one embodiment, the pH of the solution fed into the cell ranges from about 5 to about 7, for example from about 5.5 to about 6.9, such as from about 5.8 to about 6.9.

According to one embodiment, the electrolyte solution contains alkali metal halide, e.g. sodium chloride in a concentration from about 80 to about 180, for example from about 100 to about 140 or from about 106 to about 125 g/l. According to one embodiment, the electrolyte solution contains alkali metal chlorate in a concentration from about 450 to about 700, e.g. from about 500 to about 650 or from about 550 to about 610 g/l.

According to one embodiment, the process is used for producing sodium chlorate or potassium chlorate, but other alkali metal chlorates can also be produced. The production of potassium chlorate can be effected by adding a purified potassium chloride solution to an alkalized partial flow of electrolytically produced sodium chlorate, succeeded by precipitation of crystals by cooling and/or evaporation. The chlorate is suitably produced by a continuous process, but a batchwise process can also be used.

According to one embodiment, alkali metal chloride in the form of a technical-grade salt and raw water are supplied to prepare salt slurry. Such a preparation is disclosed e.g. in EP-A-0 498 484. According to one embodiment, the flow to the chlorate cells normally is from 75 to 200 $m^3$ of electrolyte per metric ton of alkali metal chlorate produced.

According to one embodiment, each chlorate cell operates at a temperature ranging from about 50 to about 150, for example from about 60 to about 90° C. depending on the over-pressure in the cell-box that can be up to 10 bar. According to one embodiment, a part of the chlorate electrolyte is recycled from the reaction vessels to the salt slurry, and some for alkalization and electrolyte filtration and final pH adjustment before the chlorate crystallizer. The thus-alkalized electrolyte is at least partly fed to the crystallizer, in which water is evaporated, sodium chlorate crystallized and withdrawn over a filter or via a centrifuge while water driven off is condensed.

According to one embodiment, the mother liquor, which is saturated with respect to chlorate and contains high contents of sodium chloride is recycled directly to the preparation of salt slurry and via cell gas scrubbers and reactor gas scrubbers.

According to one embodiment, the pressure in the cell is about 20 to 30 mbar above atmospheric pressure.

According to one embodiment, the (electrical) conductivity in the cell electrolyte ranges from about 200 to about 700, for example from about 300 to about 600 mS/cm.

The invention being thus described, it will be obvious that the same may be varied in many ways. The following examples will further illustrate how the described invention may be performed without limiting the scope of it.

All parts and percentages refer to part and percent by weight, if not otherwise stated.

EXAMPLE 1

A small chlorate producing pilot plant comprising an electrolyzing cell and a reaction vessel (also acting as a gas separator) was used. The electrolyte was circulated by means of a pump. On top of the reactor vessel, gas was withdrawn; a small amount of chlorine species was absorbed in 5 Molar sodium hydroxide; water was completely eliminated by adsorption in desiccant. The oxygen content in the remaining gas was then measured continuously in % by volume. The oxygen flow (liter/s) was also measured in order to calculate the cathodic current efficiency (CCE) on the cathode. The hydrogen flow rate was determined by subtracting the oxygen part from the total gas flow rate. The CCE was then calculated from the hydrogen flow rate using the following expression CCE=(Normal liter $H_2$ per second 122.4)·(2F/I), where F is Faraday's constant, and I is the current through the cell in ampere.

The starting electrolyte used was a water solution containing 120 g/L NaCl and 580 g/L $NaClO_3$. The anode in the electrolyzing cell was a PSC120 (DSA®, $TiO_2/RuO_2$) available from Permascand. As cathode material a MAXTHAL® 312 ($Ti_3SiC_2$) (4.1 g/cm$^3$) available from Kanthal with a machined surface was used. The distance between the anode and the cathode was about 4 mm. The exposed geometrical surface area for electrolysis, for the anode and cathode respectively, was 30 cm$^2$. A current density of 3 kA/m$^2$ both on the anode and the cathode was used in each experiment. The temperature in the electrolyte during the experiments was 80±2° C.

The activation of the cathode by addition of $MoO_3$ as set out in table 1 is clearly seen, with low amounts of $Na_2Cr_2O_7.2H_2O$ (~9 μM, corresponding to 18 μM as Cr) also present in the electrolyte.

In table 1, it can be noted that the experiments in which small amounts of $MoO_3$ were used in the electrolyte resulted in oxygen evolution of 3.5-3.8%. A significant activation effect can be noticed in table 1, although the amount of $MoO_3$ in the electrolyte is very low. The values in table 1 are taken after stable conditions has been reached, after each addition.

TABLE 1

| Oxygen (%) | CCE (%) | Cell voltage (V) | Amount of $MoO_3$ in electrolyte |
|---|---|---|---|
| 3.8 | ~100 | 3.27 | — |
| 3.8 | ~100 | 3.21 | 1 mg/L (0.007 mM) |
| 3.7 | ~100 | 3.17 | 2 mg/L (0.014 mM) |
| 3.6 | ~100 | 3.15 | 5 mg/L (0.035 mM) |
| 3.5 | ~100 | 3.15 | 10 mg/L (0.07 mM) |

EXAMPLE 2

Long term effects were studied as 1 mg/L (0.007 mM) and 100 mg/L (0.7 mM) respectively of $MoO_3$ were added to the electrolyte (table 2). The setup was as in example 1 (with a new MAXTHAL® 312 electrode as cathode).

TABLE 2

| Oxygen (%) | CCE (%) | Cell voltage (V) | $MoO_3$ in electrolyte* |
|---|---|---|---|
| >4 | ~100 | 3.31 | — |
| 3.5* | ~100** | 3.15** | 1 mg/L (0.007 mM) |
| >>4** | ~100** | 3.11** | 100 mg/L (0.7 mM) |

*5 h after addition of $MoO_3$.
**4 h after addition of $MoO_3$.

It is clear that the experiment with 100 mg/L $MoO_3$ results in considerable oxygen levels. The cathode is, however, considerably activated.

EXAMPLE 3

In a test to study how the cathodic current density affects the activation of the cathode (a new MAXTHAL® 312), the setup and starting electrolyte of example 1 was used. After having added 50 mg/L (0.35 mM) of $MoO_3$ to the electrolyte an activation of the cell voltage to 3.05 V was stabilized at 2 kA/m$^2$. Then, the current density at the cathode was increased to 3 kA/m$^2$ for about 1.5 h and then lowered again to 2 kA/m$^2$. The cathode became further activated by about 20 mV only by the increase in current density for a period of three minutes.

EXAMPLE 4

A number of small scale experiments in which molybdenum was added to the electrolyte were performed. A 5 M NaCl(aq) solution was used in all electrolytes. No chromate was present in the experiments. As a working electrode a titanium disk was used rotating at 3000 rpm at 70° C. and pH 6.5. Six experiments were performed in which the potential at the working electrode was kept at −1.5 V vs. Ag/AgCl for five minutes. After this the potential was lowered. At a certain current density, 0.5 kA/m$^2$ on the working electrode, readings of the potential versus Ag/AgCl were sampled as set out in tables 3 (5 M NaCl) and 4 (5M NaCl, 15 mM NaClO).

TABLE 3

| No | $C(Na_2MoO_4)$, mM | $C(MoO_3)$, mM | E (V) vs. Ag/AgCl |
|---|---|---|---|
| 1 | 0 | 0 | −1.50 |
| 2 | 1 | 0 | −1.25 |
| 3 | 0 | 1 | −1.25 |

TABLE 4

| No | $C(Na_2MoO_4)$, mM | $C(MoO_3)$, mM | E (V) vs. Ag/AgCl |
|---|---|---|---|
| 1 | 0 | 0 | −1.47 |
| 2 | 1 | 0 | −1.19 |
| 3 | 0 | 1 | −1.19 |

It is clear that small amounts of molybdenum species reduces the voltage on the titanium cathode.

EXAMPLE 5

As a test to see how a tungsten species compares to molybdenum species as activator, three experiments were performed, also here using a rotating disk. In this case the electrode material was Maxphase (Maxthal 312® from Kanthal). In this experiment the disk was rotating at 3000 rpm, polarized at 2 kA/m$^2$. The electrolyte solution contained 5 M NaCl(aq) at a temperature of 70° C., and a pH of 6.5. The experiments were performed according to table 5 and readings were performed after 15 minutes.

TABLE 5

| No | Additive | E (V) vs. Ag/AgCl* |
|---|---|---|
| 1 | None | −1.53 |
| 2 | 10 mM $Na_2MoO_4$ | −1.39 |
| 3 | 10 mM $Na_2WO_4$ | −1.43 |

*Potential was corrected for iR drop

EXAMPLE 6

To study the effect of chromium, four experiments were performed with electrolytes as set out in table 6. A titanium disk was used as working electrode, rotating at 3000 rpm at 70° C. and pH 6.5. The potential at the working electrode was kept at −1.5 V vs. Ag/AgCl for five minutes. After this the potential was lowered by a rate of 50 mV/s and the current density on the working electrode was monitored. In the experiments the current density was sampled at around −0.8 V vs. Ag/AgCl and used as measurement of how significant the reduction of hypochlorite is. Higher cathodic currents at this potential will point to more reduction of hypochlorite and hence a lower selectivity for the hydrogen evolution, eventually resulting in a lower cathodic current efficiency, as measured in examples 1 and 2.

TABLE 6

| No | Electrolyte composition | Current density at −0.8 V vs. Ag/AgCl |
|---|---|---|
| 1 | 5M NaCl + 15 mM NaClO | −0.33 kA/m$^2$ |
| 2 | 5M NaCl + 15 mM NaClO + 20 μM Cr(VI) | −0.01 kA/m$^2$ |
| 3 | 110 g/dm3 NaCl + 550 g/dm3 NaClO3 + 15 mM NaClO + 18 μM Cr(VI) | −0.02 kA/m$^2$ |
| 4 | 110 g/dm3 NaCl + 550 g/dm3 NaClO3 + 15 mM NaClO + 2 μM Cr(VI) | −0.14 kA/m$^2$ |

The invention claimed is:

1. Process for reducing cell voltage in an electrolytic cell during production of alkali metal chlorate comprising electrolyzing an electrolyte comprising alkali metal chloride in the electrolytic cell in which at least one anode and at least one cathode are arranged wherein a) said electrolyte comprises chromium in any form in an amount ranging from $0.01\cdot10^{-6}$ to $100\cdot10^{-6}$ mol/dm$^3$ b) a cathode electrodepositing solution is provided to the electrolyte, the cathode electrodepositing solution comprising molybdenum, tungsten, vanadium, manganese and/or mixtures thereof in any form in a total amount ranging from $0.1\cdot10^{-6}$ to $0.1\cdot10^{-3}$ mol/dm$^3$ to form a cathode coating during the process for production of alkali metal chlorate, and wherein the at least one anode and the at least one cathode consist of a substrate consisting of at least one of titanium, titanium suboxide, and MAX phase, and further wherein the cathode is void of iron or iron compounds and has a density from 3 to 20 g/cm$^3$.

2. Process according to claim 1, wherein the chromium in any form is a chromium compound that is added to the electrolyte in the form of $Na_2CrO_4$, $Na_2Cr_2O_7$, $CrO_3$ and/or mixtures thereof.

3. Process according to claim 1, wherein the cell is undivided.

4. Process according to claim 1, wherein the shape of the at least one anode and/or the at least one cathode is cylindrical.

5. Process according to claim 1, wherein the chromium is present in the electrolyte in an amount ranging from $0.1\cdot10^{-6}$ to $50\cdot10^{-6}$ mol/dm$^3$.

6. Process according to claim 1, wherein the molybdenum, tungsten, vanadium, manganese and/or mixtures thereof is present in the electrolyte in an amount from $0.001\cdot10^{-3}$ to $0.1\cdot10^{-3}$ mol/dm$^3$.

7. Process according to claim 1, wherein the at least one cathode substrate is selected from titanium, MAX phase, and/or mixtures thereof.

8. Process according to claim 1, wherein the current density at the at least one anode ranges from 0.6 to 4 kA/m$^2$.

9. Process according to claim 1, wherein the current density at the at least one cathode ranges from 0.05 to 4 kA/m$^2$.

10. Process according to claim 8, wherein the current density at the at least one anode ranges from 1 to 3.5 kA/m$^2$.

11. Process according to claim 9, wherein the current density at the at least one cathode ranges from 0.6 to 2.5 kA/m$^2$.

12. Process according to claim 5, wherein the chromium is present in the electrolyte in an amount ranging from $5\cdot10^{-6}$ to $30\cdot10^{-6}$ mol/dm$^3$.

13. Process according to claim 6, wherein the molybdenum, tungsten, vanadium, manganese and/or mixtures thereof is present in the electrolyte in an amount from $0.01\cdot10^{-3}$ to $0.05\cdot10^{-3}$ mol/dm$^3$.

14. Process according to claim 1, wherein the at least one anode has a density from 3 to 20 g/cm$^3$.

15. Process according to claim 1, wherein the density of the at least one cathode is from 4 to 5 g/cm$^3$.

16. Process for reducing cell voltage in an electrolytic cell during production of alkali metal chlorate, the process comprising:

arranging an anode and a cathode in the electrolytic cell, wherein the anode and the cathode consist of a substrate consisting of at least one of titanium, titanium suboxide, and MAX phase, and the cathode is void of iron or iron compounds;

reducing voltage on the cathode while producing alkali metal chlorate by forming a cathode coating on at least a portion of the cathode, wherein the cathode coating is formed by depositing a cathode electrodepositing solution onto the cathode and is provided to an electrolyte in the electrolytic cell during said process, wherein the cathode electrodepositing solution comprises molybdenum, tungsten, vanadium, manganese and/or mixtures thereof in any form in a total amount ranging from $0.1\cdot10^{-6}$ to $0.1\cdot10^{-3}$ mol/dm$^3$; and electrolyzing the electrolyte in the electrolytic cell to produce the alkali metal chlorate, wherein the electrolyte comprises the cathode electrodepositing solution, alkali metal chloride and chromium in any form in an amount ranging from $0.01\cdot10^{-6}$ to $100\cdot10^{-6}$ mol/dm$^3$.

* * * * *